US011957262B2

(12) United States Patent
Hsu et al.

(10) Patent No.: US 11,957,262 B2
(45) Date of Patent: Apr. 16, 2024

(54) DEVICE FOR INSTALLING CURTAIN GLIDERS

(71) Applicant: CARROT INDUSTRIAL CO., LTD., Kaohsiung (TW)

(72) Inventors: Hsiu-Mei Hsu, Kaohsiung (TW); Hou-Cheng Ko, Kaohsiung (TW)

(73) Assignee: Carrot Industrial Co., Ltd., Kaohsiung (TW)

( * ) Notice: Subject to any disclaimer, the term of this patent is extended or adjusted under 35 U.S.C. 154(b) by 308 days.

(21) Appl. No.: 17/179,978

(22) Filed: Feb. 19, 2021

(65) Prior Publication Data

US 2022/0265078 A1 Aug. 25, 2022

(51) Int. Cl.

| | |
|---|---|
| ***A47H 15/04*** | (2006.01) |
| ***A47H 99/00*** | (2009.01) |
| *A47H 1/04* | (2006.01) |

(52) U.S. Cl.

CPC ..... *A47H 99/00* (2013.01); *A47H 15/04* (2013.01); *A47H 1/04* (2013.01)

(58) Field of Classification Search

CPC ..... A47H 13/00; A47H 13/01; A47H 13/02; A47H 13/04; A47H 15/00; A47H 15/02; A47H 15/04; A47H 2015/005; A47H 99/00

See application file for complete search history.

(56) References Cited

U.S. PATENT DOCUMENTS

| | | | | |
|---|---|---|---|---|
| 2,317,531 | A * | 4/1943 | Leslie | A47H 15/02 206/326 |
| 3,396,834 | A * | 8/1968 | Luckey | A47H 13/00 206/326 |
| 3,600,741 | A * | 8/1971 | Bays | A47H 13/00 16/87.8 |
| 3,958,691 | A * | 5/1976 | Schaeffer | A47H 15/00 206/326 |
| 4,282,630 | A * | 8/1981 | Toder | A47H 15/04 206/343 |
| 7,788,769 | B2 * | 9/2010 | Wicker | A47H 13/04 160/346 |
| 9,717,362 | B1 * | 8/2017 | Birch | A47H 15/02 |
| 11,297,968 | B2 * | 4/2022 | Ko | A47H 15/04 |
| 2015/0129141 | A1 * | 5/2015 | Kao | A47H 15/02 16/87 R |
| 2018/0279818 | A1 * | 10/2018 | Goelst | A47H 13/01 |

FOREIGN PATENT DOCUMENTS

| | | |
|---|---|---|
| TW | M469015 U | 1/2014 |
| TW | M470617 U | 1/2014 |

* cited by examiner

*Primary Examiner* — Abe Massad

(74) *Attorney, Agent, or Firm* — Rosenberg, Klein & Lee

(57) ABSTRACT

A device for installing curtain gliders is revealed. The device for installing curtain gliders is a positioning strip. A plurality of gliders are arranged at the positioning strip and then carried and mounted into a curtain track by the positioning strip. The positioning strip is provided with a plurality of mounting and positioning units each of which includes a main hole, two slots disposed on two ends of the main hole, and two locking pieces located between the two slots and the main hole. Thereby the glider with different designs can be inserted into the main hole and the locking pieces are abutting against the glider for positioning the glider. Installers can assemble the gliders quickly and conveniently by count marks on the positioning strip.

6 Claims, 12 Drawing Sheets

DEVICE FOR INSTALLING CURTAIN GLIDERS

BACKGROUND OF THE INVENTION

Field of the Invention

The present invention relates to a device for installing curtain gliders, especially to a device for installing curtain gliders able to be applied to various types of curtain gliders, having broader and more generalized application.

Description of Related Art

A curtain assembly generally includes a curtain track, a plurality of gliders sliding along the curtain track, and a curtain hanging on the gliders. The curtain hanging under the curtain track is open and closed by the gliders. However, the gliders are equally spaced on a cord and each of the gliders is pivotally connected to a roller which enables the glider to slide in the curtain track after the glider being mounted into the curtain track. A pendent member such as hook is arranged at the bottom of the glider for connecting and fixing the curtain. While being assembled, a certain number of gliders on the cord required is cut and mounted into the curtain track in turn. Then the top side of the curtain is connected to the pendent members of the respective gliders. Thereby the curtain is pulled to the desired position easily by the rollers of the respective gliders sliding in the curtain track.

While in use, the number of the gliders required is determined according to the length of the curtain track. Then a part of the cord with a series of gliders is cut to get the desired number of the gliders. Next the gliders are mounted into the curtain track in turn. The assembly process is time consuming. Once one of the gliders is assembled in the wrong direction, all of the gliders need to be removed and mounted again. This is not only labor intensive but also causing loss of work efficiency. Moreover, the gliders are equally spaced on a cord. When the goods are delivered from the factory, the cord with gliders is packed in rolls so that the cord and the gliders are easy to create tangles or knots. This leads to inconvenience in assembly of the gliders with the curtain track.

In order to prevent tangling and knotting mentioned above, some people in the business have developed plastic bag for containing gliders and preventing the cord from tangling. However, two processes for loading the gliders into the plastic bag are time and labor consuming. Refer to Taiwanese Pat. Pub. No. M469015(U), an installation device for curtain sliding members is revealed. The installation device is provided with a connection member corresponding to the curtain sliding member. A roller is pivotally connected to the curtain sliding member and a connection portion is disposed on a lower end thereof for hanging curtains. A mounting portion is extended from the curtain sliding member and a mounting block is arranged at the mounting portion. As to the connection member, it is a long strip provided with a plurality of positioning slots which allow the mounting portion of the curtain sliding member to be mounted therein. A positioning bump is formed on the positioning slot and corresponding to the mounting block of the mounting portion. The positioning bump and the mounting block of the mounting portion are positioned by each other.

Also refer to Taiwanese Pat. Pub. No. M470617(U), another installation device for curtain sliding members is disclosed. The installation device is provided with a connection member corresponding to the curtain sliding member. A connection portion is disposed on a lower end of the curtain sliding member for hanging curtains while an extension segment is arranged at the connection portion and provided with a mounting bump. The connection member is a long strip provided with a plurality of positioning slots corresponding to the extension segment of the curtain sliding member. Thus the extension segment of the curtain sliding member is mounted into the positioning slot and positioned by the mounting bump to be outside the positioning slot.

The above two prior arts provide different connection members for the respective curtain sliding members (gliders). Each type of the gliders has the corresponding connection member which is produced by molding. The connection member is unable to be applied to other types of gliders. Producing small lots by molding is not cost effective.

Thus there is room for improvement and there is a need to provide a novel device for installing curtain gliders not only addressing the above problems but also more practical to use.

SUMMARY OF THE INVENTION

Therefore it is a primary object of the present invention to provide a device for installing curtain gliders able to be applied to various types of curtain gliders, getting broader and more generalized application.

In order to achieve the above object, a device for installing curtain gliders according to the present invention mainly includes a positioning strip. A plurality of gliders are arranged at the positioning strip and then carried and mounted into a curtain track by the positioning strip. The positioning strip is provided with a plurality of mounting and positioning units each of which includes a main hole, two slots disposed on two ends of the main hole, and two locking pieces located between the two slots and the main hole. Thereby the glider with different designs can be inserted into the main hole and the locking pieces are abutting against the glider for positioning the glider. The device for installing curtain gliders is not only more convenient to use but also providing quick and convenient assembly of the curtain gliders.

Preferably, a cutting notch is arranged between the two adjacent mounting and positioning units of the positioning strip for allowing installers to cut the mounting and positioning units conveniently.

Preferably, a count mark is disposed per a certain number of the mounting and positioning units of the positioning strip for allowing installers to count and cut the desired number of the mounting and positioning units. Thus the curtain gliders are easy to pack and easy to install for the installers.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
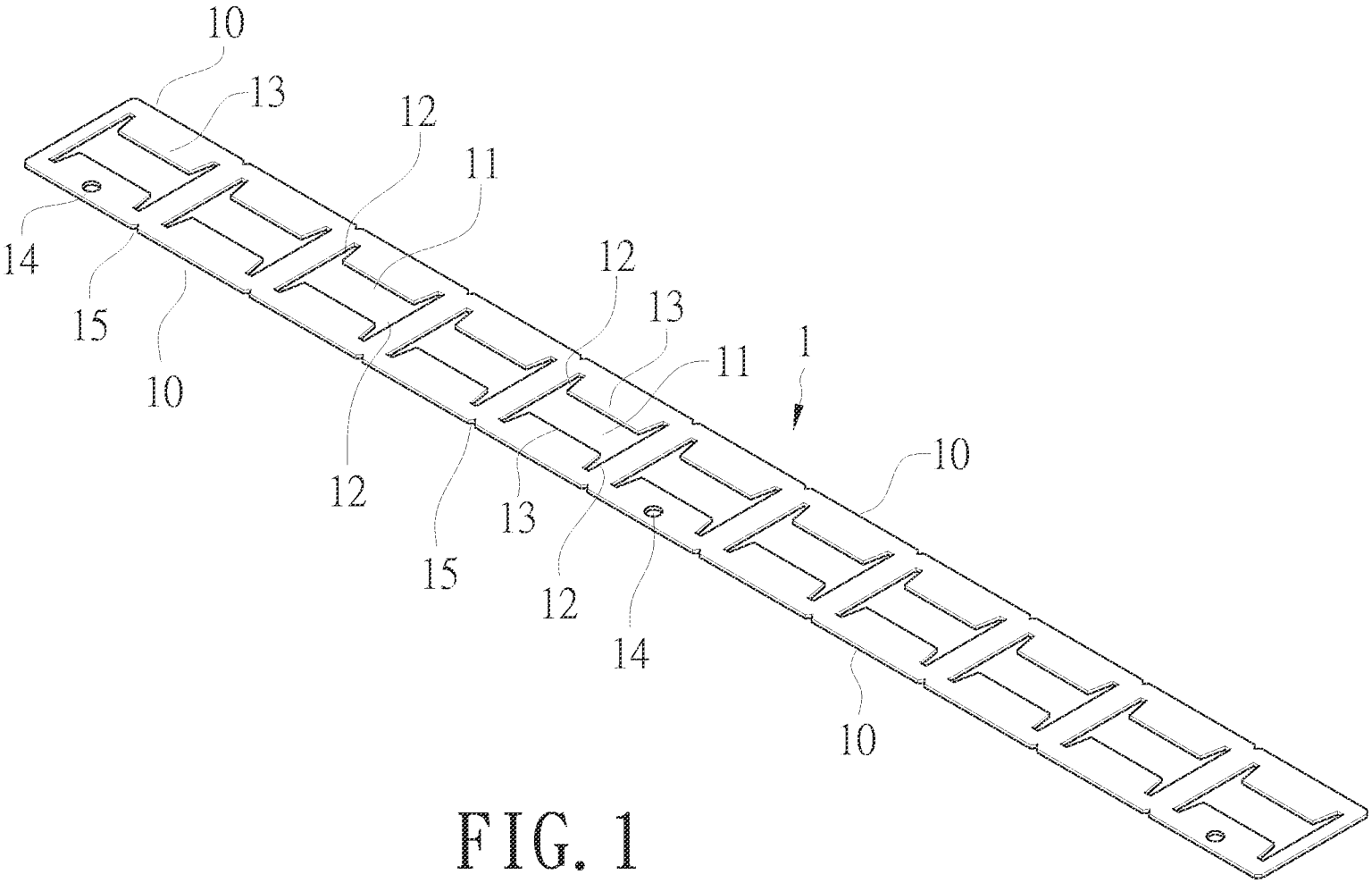
FIG. 1 is a perspective view of an embodiment according to the present invention.
Figure 2:
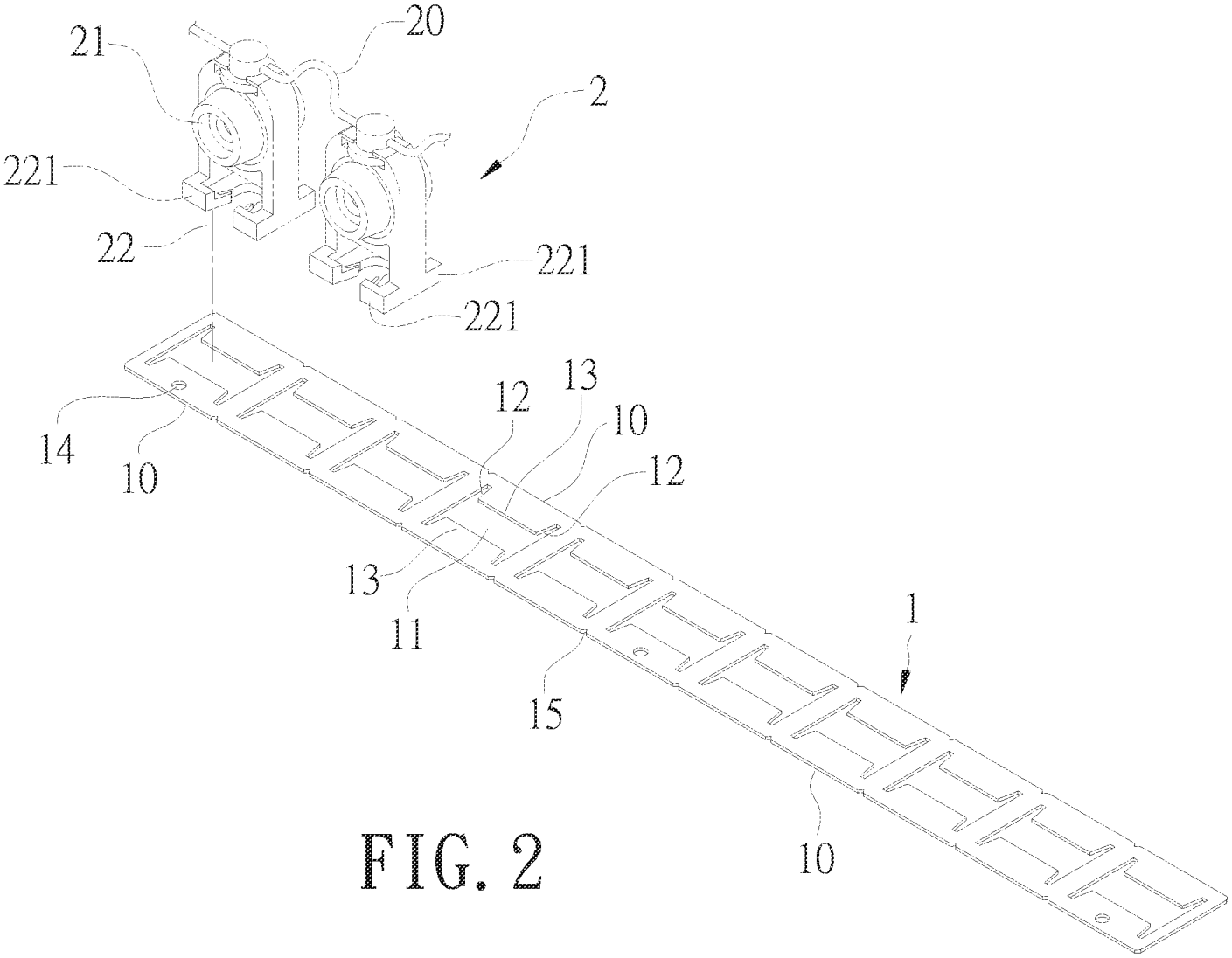
FIG. 2 is an explosive view of an embodiment according to the present invention.
Figure 3:
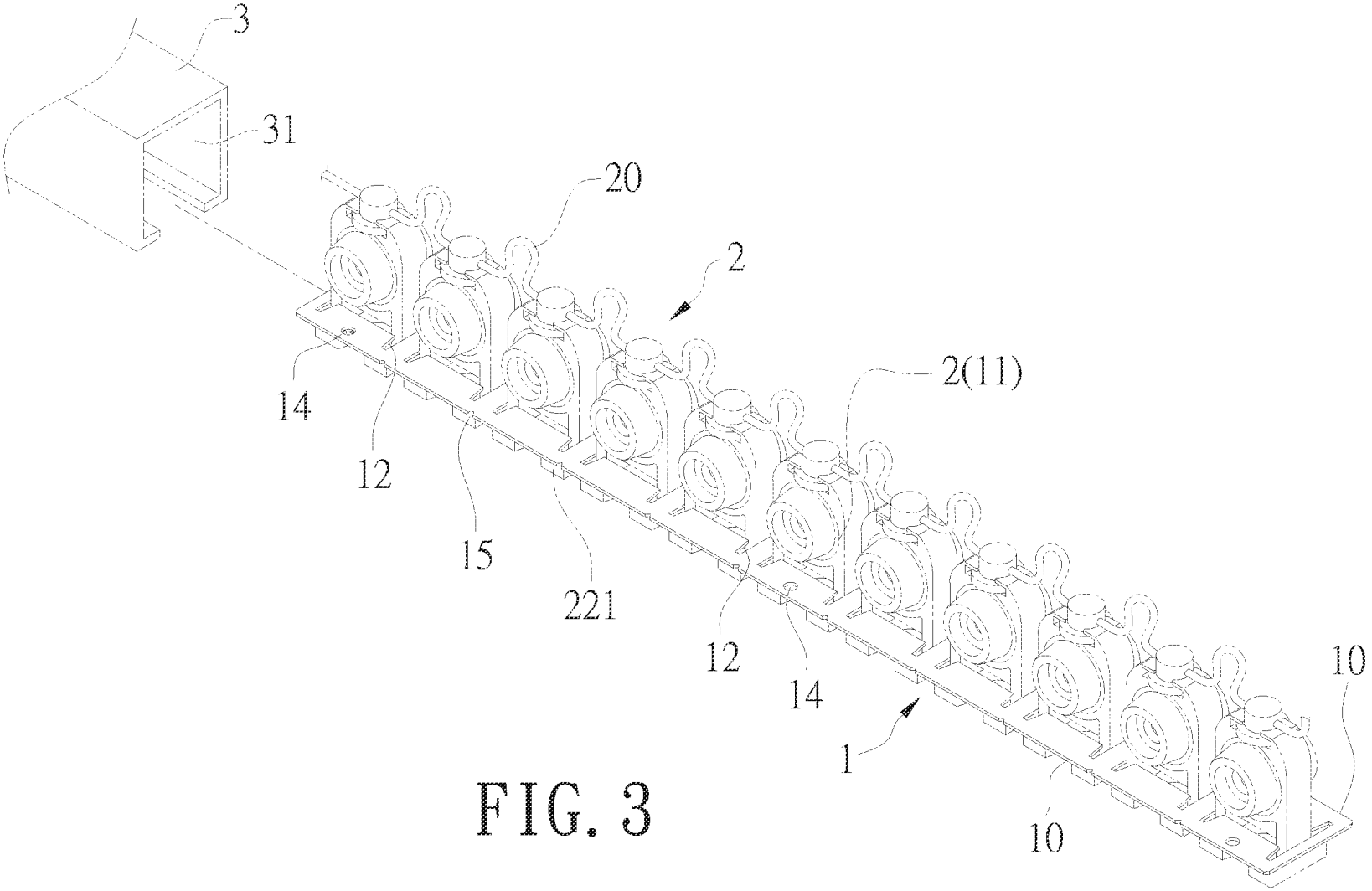
FIG. 3 is a schematic drawing showing an assembly of an embodiment according to the present invention.

Refer to FIG. 1, FIG. 2, and FIG. 3, a device for installing curtain gliders according to the present invention mainly includes a positioning strip 1 formed by a plurality of mounting and positioning units 10 used for carrying and positioning a plurality of gliders 2.

Each of the mounting and positioning units 10 is composed of a main hole 11, two slots 12 extended from two ends of the main hole 11 and arranged opposite to each other, and two locking pieces 13 each of which is located between the two slots 12 and the main hole 11. The slots 12 are perpendicular to the main hole 11.

While being assembled, the gliders 2 used for hanging curtains are inserted and sliding in a channel 31 of a curtain track 3 for allowing the curtains to open and close. There are different types of the channel 31 of the curtain track 3 and each type of the channel 31 is provided with suitable gliders 2. Before being mounted into the channel 31 of the curtain track 3, the respective gliders 2 are positioned by the positioning strip 1 of the present device for installation. Thus installers can mount a certain number of the gliders 2 into the channel 31 of the curtain track 3 conveniently by the positioning strip 1. The followings are different types of gliders 2.

Embodiment One

Refer to FIG. 1, FIG. 2 and FIG. 3, the glider 2 mainly includes a sliding wheel portion 21 being inserted into the channel 31 of the curtain track 3 for sliding and moving therein and a mounting portion 22 for hanging curtains (not shown in figure). Both the left side and the right side of two ends of the mounting portion 22 are provided with a protrusion 221. A cord 20 is used to connect the two adjacent gliders 2. Then the respective gliders 2 are mounted and positioned to the positioning strip 1. The mounting portion 22 of the glider 2 is aligned with and mounted into the main hole 11 whose size is able to be increased by the arrangement of the slots 12 on two ends of the main hole 11. Thus various types of the gliders 2 with different specifications and sizes can be mounted into the main hole 11. After the protrusions 221 on four corners of the mounting portion 22 of the glider 2 being mounted into the main hole 11, the protrusions 221 are abutting against and limited by the locking pieces 13 on two sides of the main hole 11 so that the glider 2 is positioned in the main hole 11 of the positioning strip 1.

Embodiment Two

Figure 4:
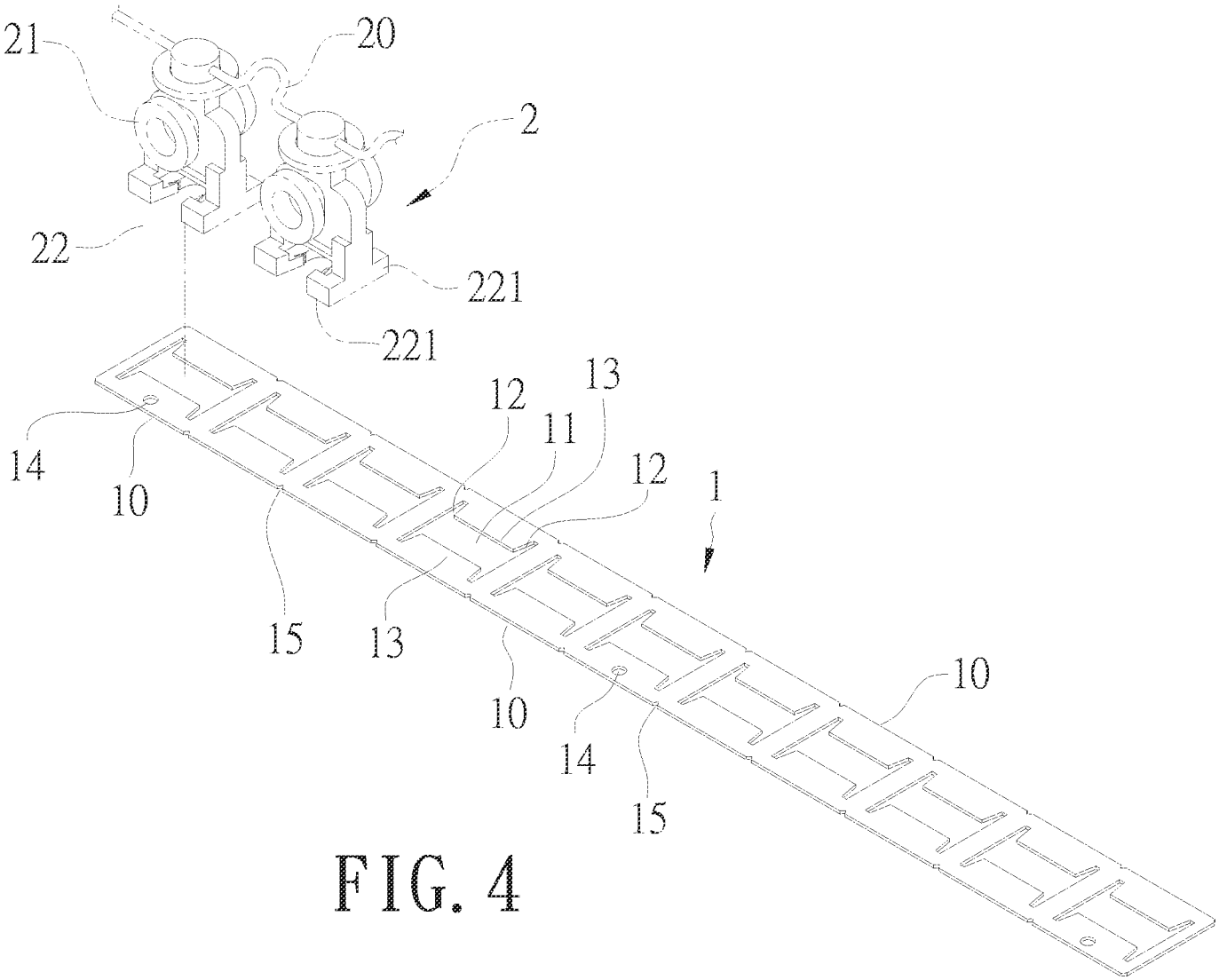
FIG. 4 is an explosive view of another embodiment according to the present invention.

Please refer to FIG. 4, the glider 2 in this embodiment is about the same as the one in the embodiment one and the only difference is in that the shapes and sizes of the sliding wheel portion 21 and the mounting portion 22. The assembly of the glider 2 of this embodiment is the same as the above one.

Embodiment Three

Figure 5:
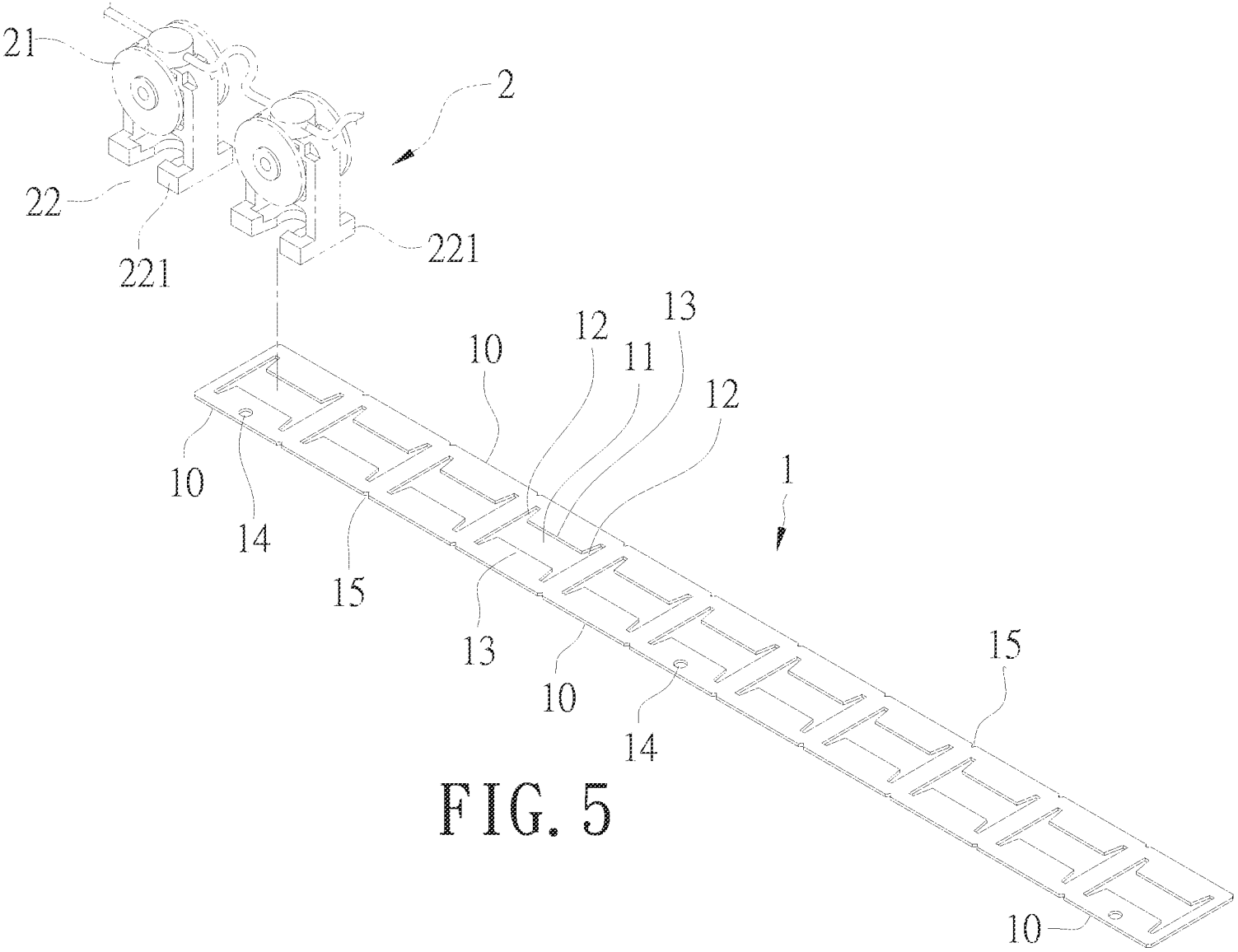
FIG. 5 is an explosive view of a further embodiment according to the present invention.

Please refer to FIG. 5, the glider 2 in this embodiment is similar to the one in the embodiment one and the only difference is in that the shapes and sizes of the sliding wheel portion 21 and the mounting portion 22. The assembly of the glider 2 of this embodiment is the same as the embodiment one.

Embodiment Four

Figure 6:
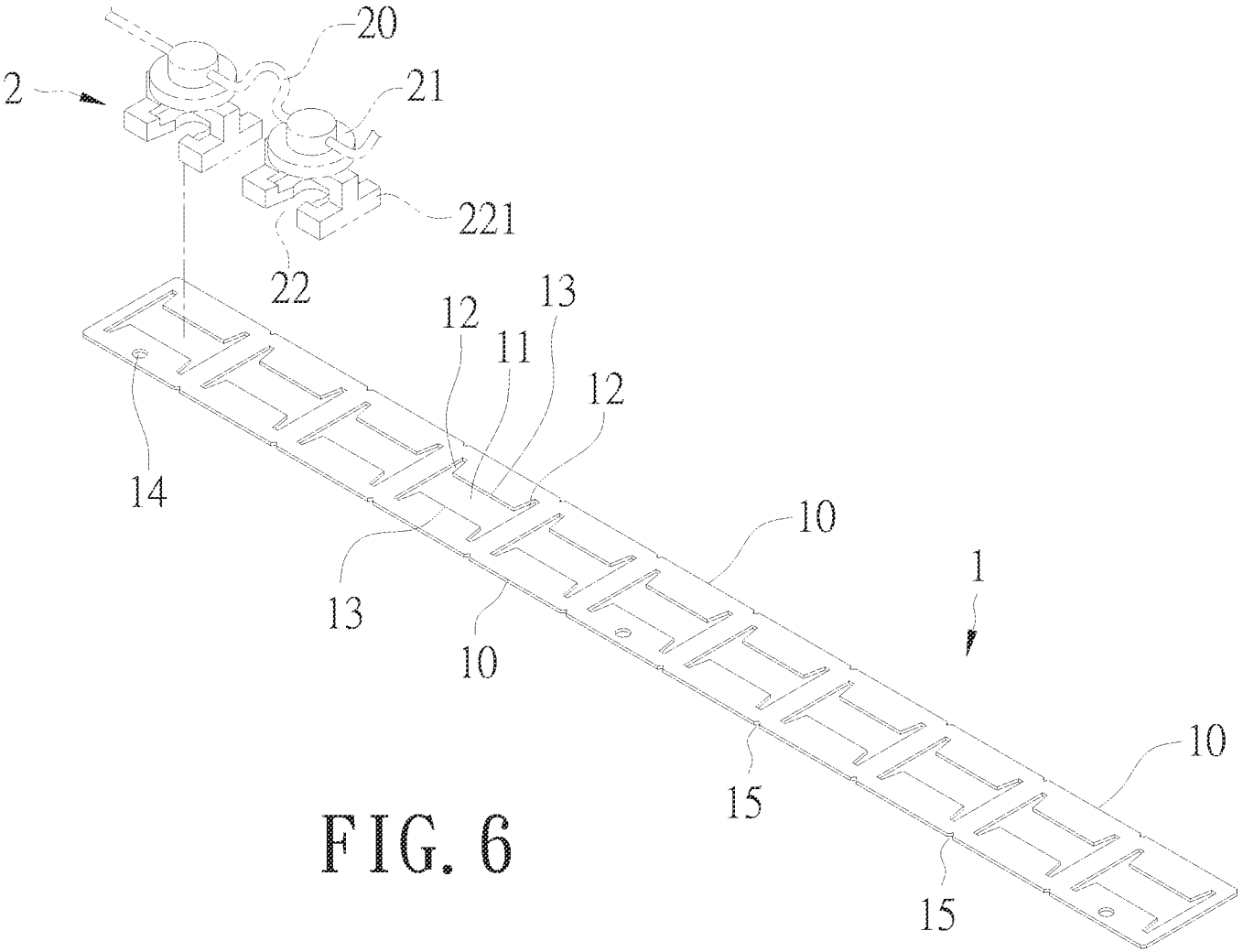
FIG. 6 is an explosive view of a further embodiment according to the present invention.
Figure 7:
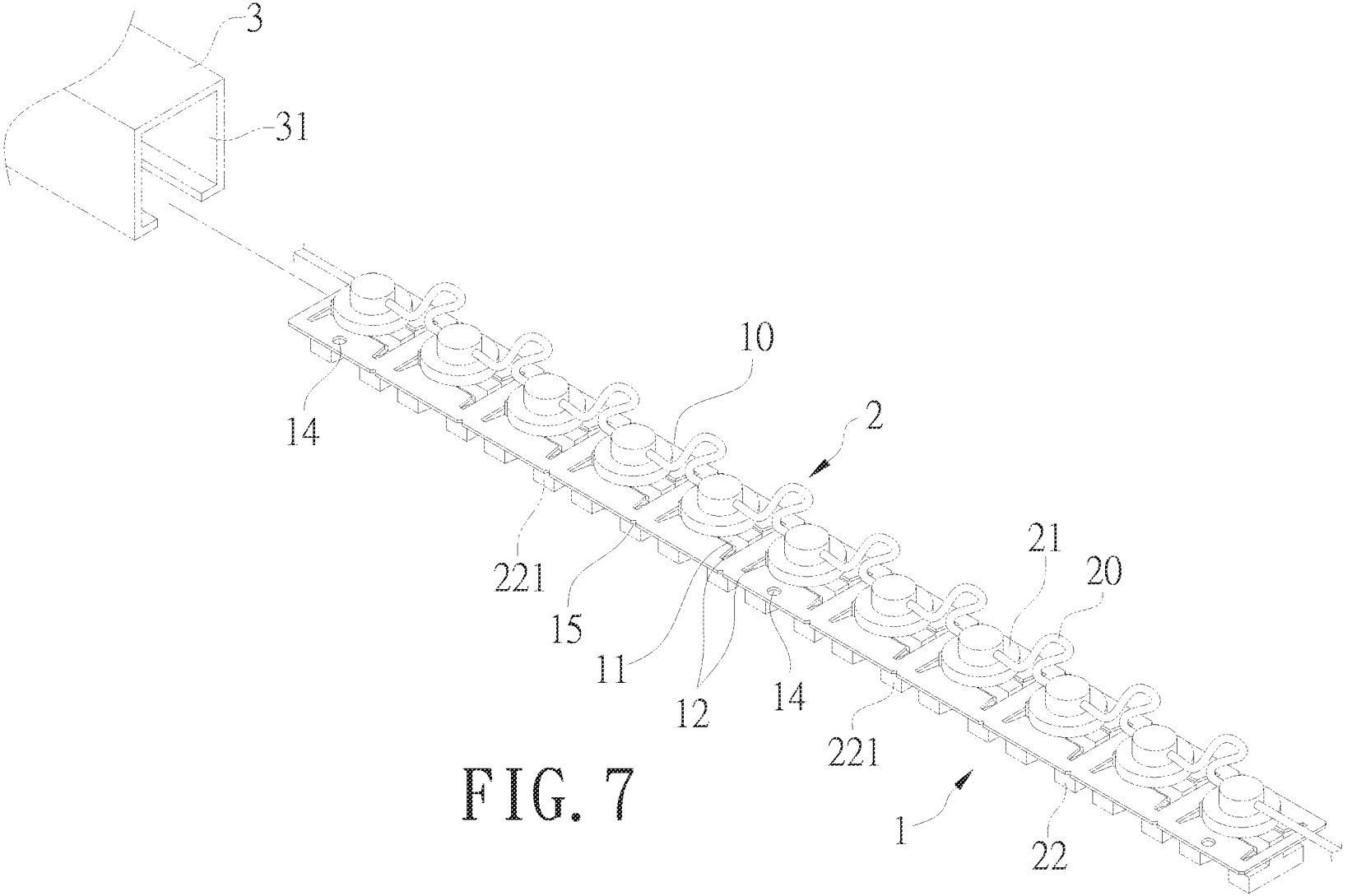
FIG. 7 is a schematic drawing showing an assembly of the embodiment in FIG. 6 according to the present invention.

Refer to FIG. 1, FIG. 6 and FIG. 7, the glider 2 in this embodiment is about the same as the one in the embodiment one, also including the sliding wheel portion 21 being inserted into the channel 31 of the curtain track 3 for sliding and moving therein and the mounting portion 22 for hanging curtains (not shown in figure). Both the left side and the right side of two ends of the mounting portion 22 are provided with a protrusion 221. The difference between this embodiment and the embodiment one is in that the position and the direction the sliding wheel portion 21 being arranged are different (for being used in combination with different tracks). The same as the embodiment one, the mounting portion 22 of the glider 2 is aligned with and mounted into the main hole 11. After the protrusions 221 on four corners of the mounting portion 22 being mounted into the main hole 11, the protrusions 221 are abutting against and limited by the locking pieces 13 on two sides of the main hole 11 to position the glider 2 in the main hole 11 of the positioning strip 1.

Embodiment Five

Figure 8:
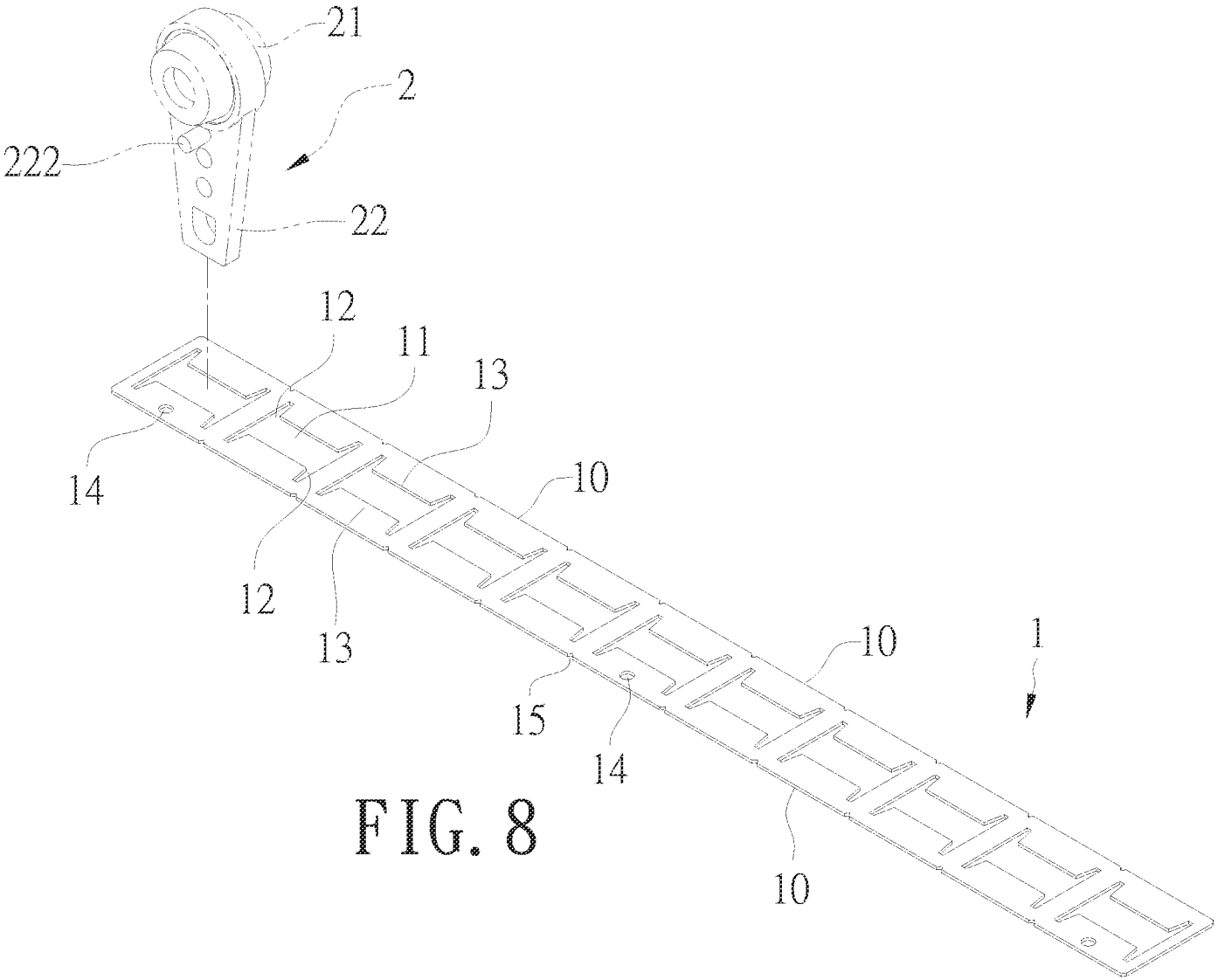
FIG. 8 is an explosive view of a further embodiment according to the present invention.
Figure 9:
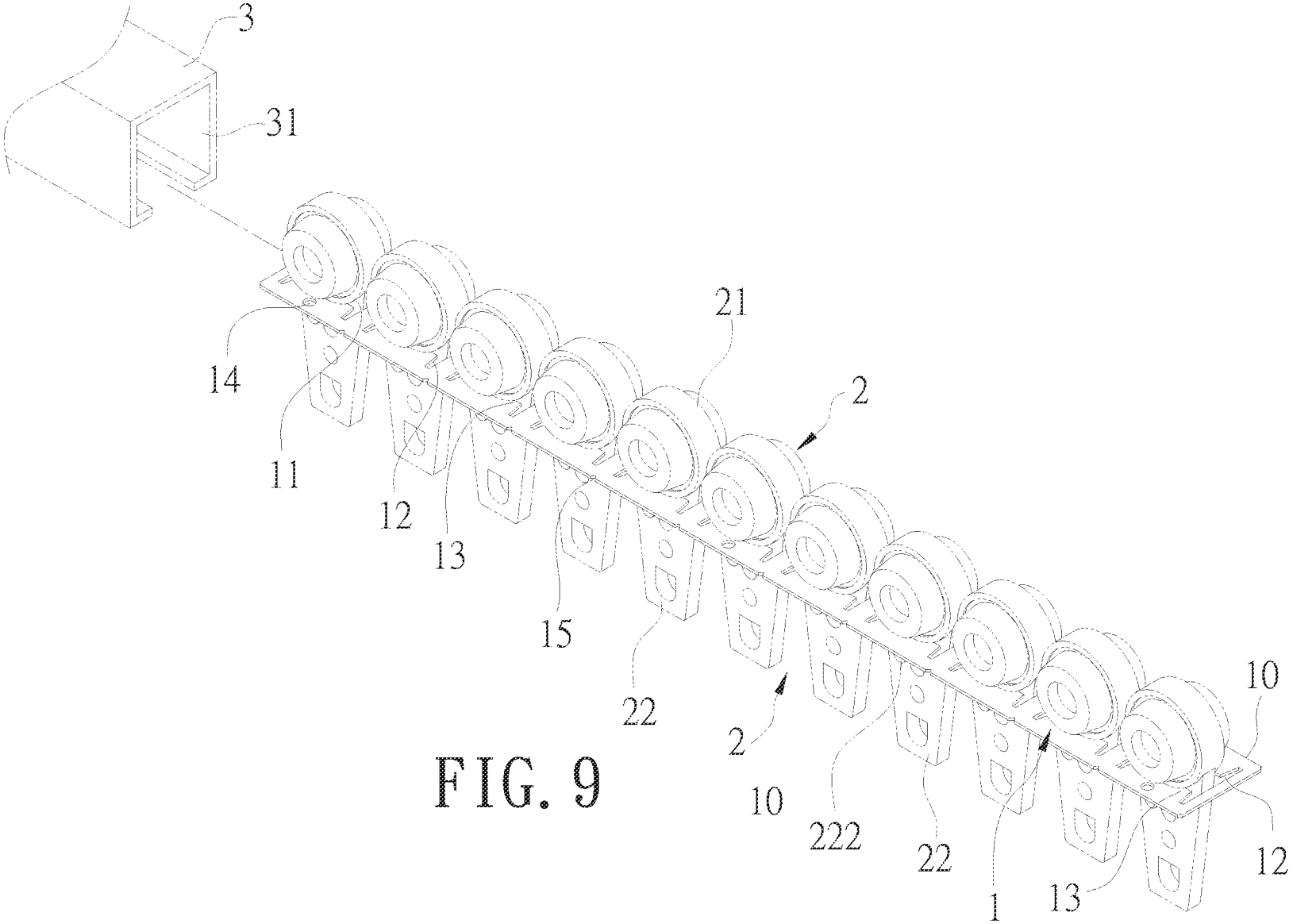
FIG. 9 is a schematic drawing showing an assembly of the embodiment in FIG. 8 according to the present invention.

Refer to FIG. 1, FIG. 8 and FIG. 9, a glider 2 in this embodiment mainly includes a sliding wheel portion 21 being inserted into the channel 31 of the curtain track 3 for sliding and moving therein, and a mounting portion 22 for hanging curtains with hooks (not shown in figure). Both left and right sides of two ends of the mounting portion 22 are provided with a protrusion 221. The difference between this embodiment and the embodiment one is in that the mounting portion 22 is a plate with bumps 222 on the left side and the right side thereof. Then the respective gliders 2 are mounted and positioned to the positioning strip 1. First the plate-like mounting portion 22 of the slider 2 is aligned with and mounted into the main hole 11. Then the bumps 222 are abutting against and limited by the locking pieces 13 on two sides of the main hole 11 for positioning the glider 2 in the main hole 11 of the positioning strip 1.

Figure 10:
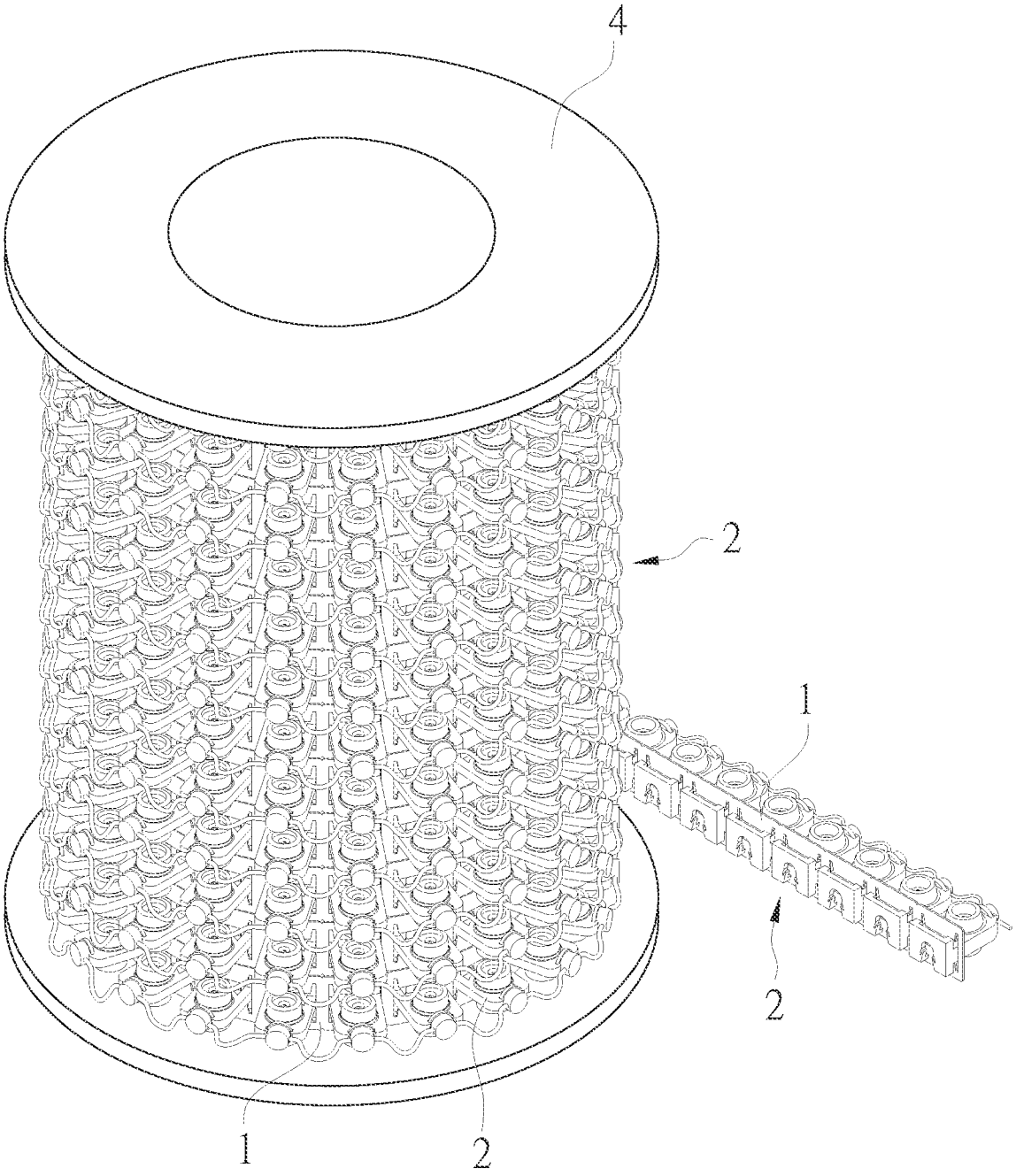
FIG. 10 is a schematic drawing showing an embodiment wound around a reel according to the present invention.
Figure 11:
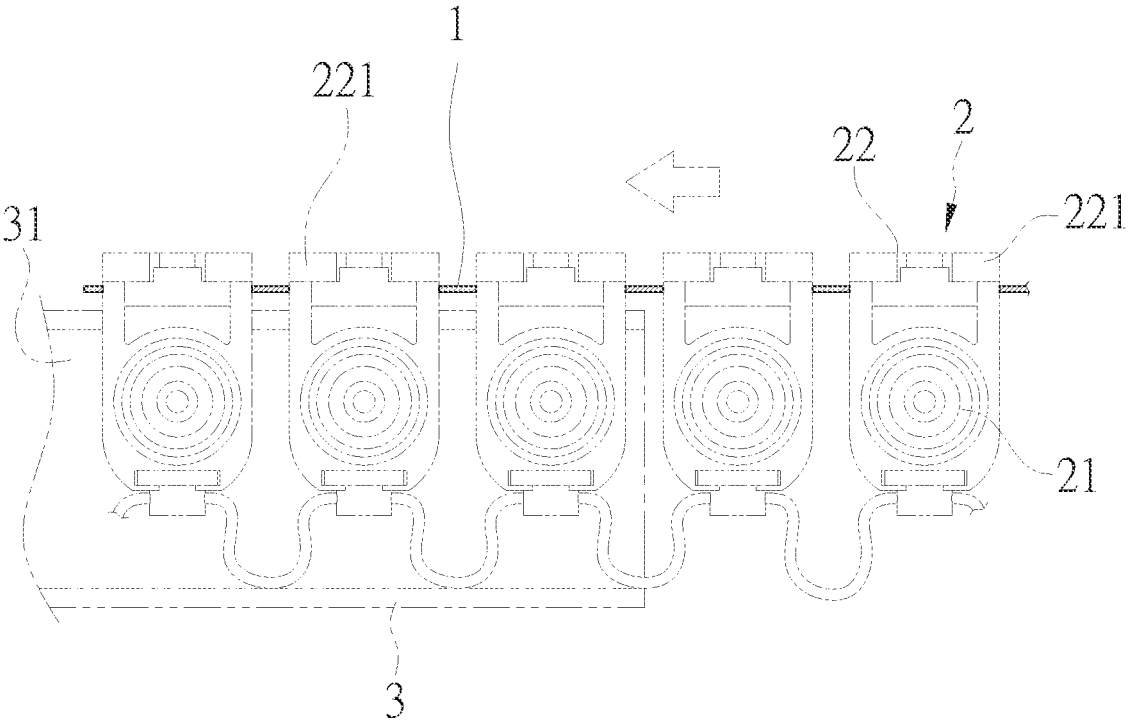
FIG. 11 is a schematic drawing showing an embodiment being mounted into a curtain track according to the present invention.
Figure 12:
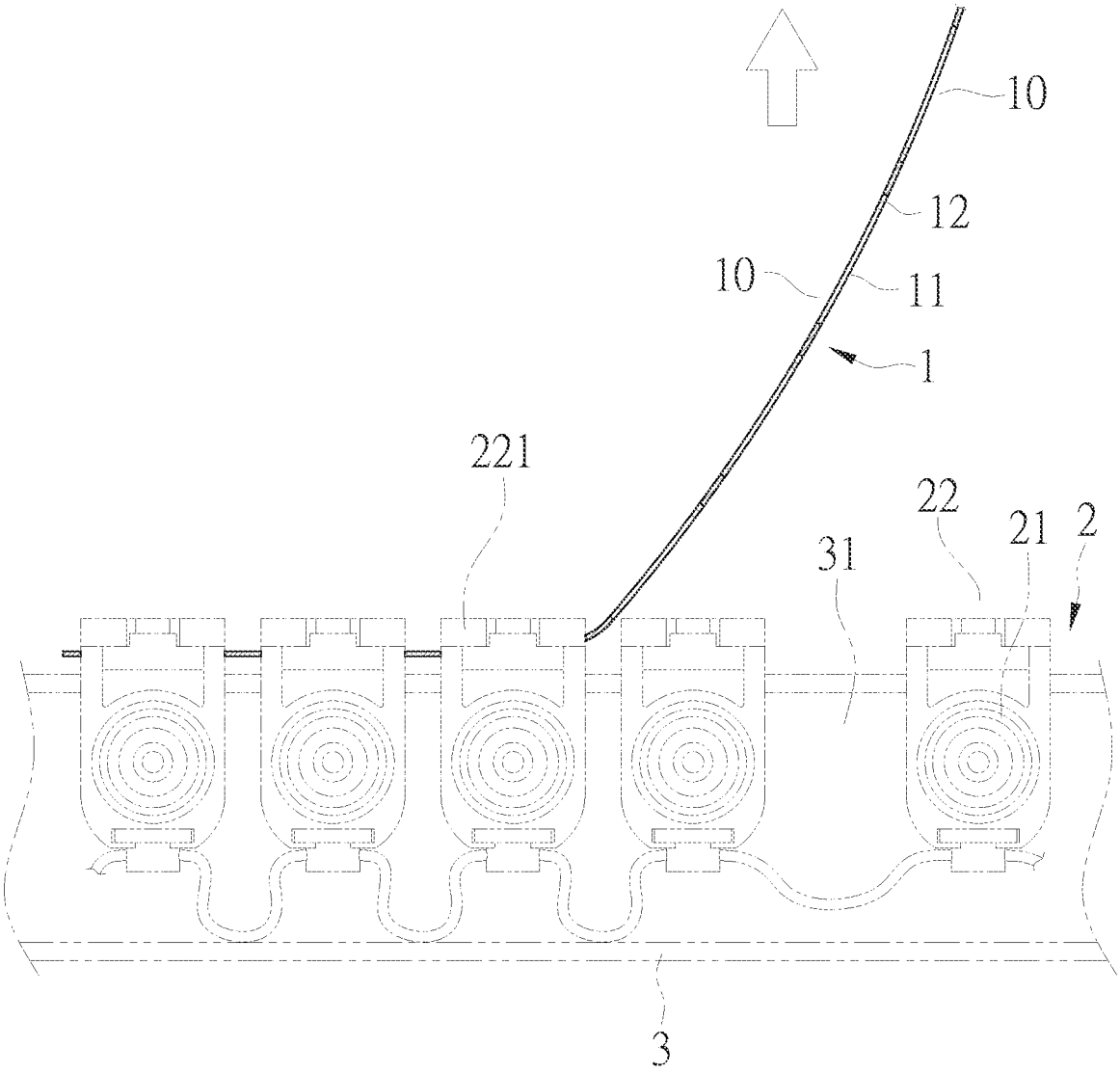
FIG. 12 is a schematic drawing showing an embodiment being removed while in use according to the present invention.

As shown in FIG. 10, after the respective gliders 2 being mounted into the mounting and positioning units 10 correspondingly, the present device for installing curtain gliders is wound around a reel 4 for tidy and easy storage. Refer to FIG. 11 and FIG. 12, while being assembled with the curtain track 3 to be used, a certain number (such as twelve) of gliders 2 are mounted in the channel 31 of the window track 3 based on the length of the curtain track 3. The curtain tracks 3 which have the same length/size are provided with a fixed number of gliders 2. Thereby a count mark 14 is arranged per a certain number of the mounting and positioning units 10, as shown in FIG. 1. The count mark 14 can be disposed per four, five, or six mounting and positioning units 10. The installer can count and learn the number of the mounting and positioning units 10 based on the count marks 14. A cutting notch 15 is arranged between the two adjacent mounting and positioning units 10 for allowing installers to cut the desired number of the mounting and positioning units 10 of the positioning strip 1 conveniently, as shown in FIG. 1.

As shown in FIG. 12, after the positioning strip 1 with a certain number of the mounting and positioning units 10 being cut, the fixed number of the gliders 2 is inserted into the channel 31 of the curtain track 3. After the mounting of the gliders 2 being completed, the positioning strip 1 is pulled and removed. Owing to allowance increased by the slots 12 on two ends of the main hole 11, the positioning strip 1 can be pulled out and released from the gliders 2 easily. Thus the assembly of the gliders 2 with the curtain track 3 is completed.

The material for the positioning strip 1 is selected from the following materials: soft plastic, sheet material, or cardboard while the positioning strip 1 is produced by stamping.

In summary, the present invention has the following advantages compared with the structure available now.

1. The present device for installing curtain gliders allows gliders with different designs able to be mounted to the main holes and positioned by the locking pieces. Thus rapid and convenient assembly is achieved.

2. By the arrangement of the cutting notch, the installer can cut the desired quantity of the positioning strip and assemble the positioning strip with the correct quantity of the gliders. Thereby the defect rate of the product caused by shortage of the gliders can be reduced.

3. The count mark arranged per a certain number of mounting and positioning units of the positioning strip makes the assembly, the package and the quality control more convenient.

4. The present device for installing curtain gliders has the following advantages compared with the techniques available now.

4.1 For quick manual assembly, the gliders can be mounted into the device for installing curtain gliders and wound around the reel in turn. Thus the gliders will not get tangled or knotted even being packed in bundles and the design is easy to pack and transport.

4.2 While being assembled with the curtain track, the device for installing curtain gliders enables quick and easy mounting of the gliders. Then the device for installing curtain gliders is removed and the assembly of the gliders is completed quickly.

4.3 The count mark is used for counting the number of the gliders. While being assembled with the curtain tracks with different lengths, each length is supplied with the correct quantity of the gliders by the count marks.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. A device for installing curtain gliders, comprising:

a plurality of curtain gliders, each of the gliders is provided with a sliding wheel portion and a mounting portion, the sliding wheel portion being inserted into a channel of a curtain track for sliding and moving therein and the mounting portion for hanging curtains;

a flexible substantially planar positioning strip, which is a flat flexible positioning strip extending in a longitudinal direction, said flexible positioning strip being flexible only in said longitudinal direction, and configured to be formed around a reel where said plurality of curtain gliders extend in a radial direction through said flat flexible positioning strip when mounted on said reel, said flexible positioning strip formed of a material selected from the group consisting of soft plastic, sheet material, and cardboard, provided with a plurality of mounting and positioning units operatively coupled to the curtain gliders for mounting and positioning the curtain gliders;

wherein each mounting and positioning unit of said plurality of mounting and positioning units includes a main hole disposed on the positioning strip, two slots extended vertically from two ends of the main hole perpendicular to the main hole and arranged opposite to each other, and a first flexible locking piece and a second flexible locking piece located between the two slots within the main hole, wherein each of said first and second flexible locking pieces has a longitudinal edge extending within and along said main hole, said longitudinal edge of said first flexible locking piece being disposed in a spaced apart relationship with the longitudinal edge of said second flexible locking piece, for flexibly displacing each of said first and second flexible locking pieces relative to each other whereby the area of the main hole is adjusted to accept curtain gliders of differing curtain glider dimensions, thus adjusting an area of said main hole, to correspond to a selected configuration of a selected curtain glider operatively coupled to said mounting and positioning units.

2. The device as claimed in claim 1, wherein a cutting notch is arranged between adjacent mounting and positioning units of said plurality of mounting and positioning units.

3. The device as claimed in claim 1, wherein a count mark is disposed per a certain number of the mounting and positioning units and used for allowing installers to count and cut the desired number of the mounting and positioning units.

4. The device as claimed in claim 2, wherein a count mark is disposed per a certain number of the mounting and positioning units and used for allowing installers to count and cut the desired number of the mounting and positioning units.

5. The device as claimed in claim 1, wherein left and right sides of two ends of each mounting portion are provided with a protrusion.

6. The device as claimed in claim 1, wherein each mounting portion is a plate with bumps on left and right sides thereof.

* * * * *